US005911268A

United States Patent [19]

Stanford

[11] Patent Number: 5,911,268

[45] Date of Patent: Jun. 15, 1999

[54] OSCILLATING MOLD TABLE ASSEMBLY

[75] Inventor: Robert L. Stanford, St. Peters, Mo.

[73] Assignee: Custom Systems, Inc., Granite City, Ill.

[21] Appl. No.: 08/951,749

[22] Filed: Oct. 16, 1997

[51] Int. Cl.[6] ..... B22D 11/04; B22D 11/16; B22D 11/124

[52] U.S. Cl. ..... 164/478; 164/416; 164/452; 164/154.4; 164/443

[58] Field of Search ..... 164/443, 478, 164/452, 416, 154.4

[56] References Cited

U.S. PATENT DOCUMENTS 3,293,707 12/1966 Olsson .
3,381,743 5/1968 Bode, Jr. .
3,610,322 10/1971 Schoffmann .
3,823,761 7/1974 Bode, Jr. .
4,224,977 9/1980 Cygler et al. .
4,298,052 11/1981 Knell et al. .
4,516,622 5/1985 Thöne et al. .
4,516,623 5/1985 Scheinecker .
4,577,277 3/1986 Kamei et al. .
4,703,789 11/1987 Reichelt et al. .
4,736,789 4/1988 Shinopulos et al. ..... 164/416
4,765,392 8/1988 Vatant .
4,883,114 11/1989 Wolf .
4,945,975 8/1990 Sorimachi et al. .
5,458,182 10/1995 Aoki et al. .
5,505,249 4/1996 Scheurecker et al. .
5,522,450 6/1996 Guttenbrunner .
5,533,565 7/1996 Kodaira et al. .
5,579,824 12/1996 Itoyama et al. .

*Primary Examiner*—Patrick Ryan
*Assistant Examiner*—I.-H. Lin
*Attorney, Agent, or Firm*—Senniger, Powers, Leavitt & Roedel

[57] ABSTRACT

A batch-casting mold table assembly for casting slabs. The assembly includes a frame positionable over a pit sized for holding cast slabs. The frame is moveable between a slab-casting position in which the frame is positioned directly over the pit for casting slabs and a slab-removal position in which the frame is positioned beside the pit so the pit is accessible for removing slabs. The assembly also includes at least one hydraulic cylinder mounted on the frame. The cylinder has a piston reciprocally moveable in response to hydraulic fluid entering and leaving the cylinder. In addition, the assembly includes a control system operatively connected to the hydraulic cylinder for controlling movement of the piston and a table for holding a batch-casting mold. The table is moveable up and down in response to the piston movement for oscillating the mold up and down over the cooling pit as molten metal is poured through the mold to produce slabs having a smooth surface finish.

16 Claims, 4 Drawing Sheets

10
126
100
128
78
74
22
66
82
14
16
40
42
44
12
90
30
54
50
32
56
R
20
46
52
48
P

OSCILLATING MOLD TABLE ASSEMBLY

BACKGROUND OF THE INVENTION

This invention relates generally to batch-casting mold table assemblies, and more particularly to a hydraulically driven mold table assembly for producing slabs having a smooth surface finish.

Batch cast slabs made of copper alloys such as brass are formed by pouring molten metal through a mold. After passing through the mold, the slabs are cooled in a fluid-filled pit located beneath the mold. Frequently, these slabs are further processed into sheets by repeatedly passing them between rollers and incrementally reducing the distance between the rollers. To obtain sheets having a good surface finish, the slabs from which the sheets are formed must have a good surface finish. Slabs having a good surface finish may be made by oscillating the mold up and down as the molten metal passes through it. The optimal speed(s) at which the mold is oscillated up and down varies depending upon the particular physical and metallurgical properties of the metal being poured and the characteristics of the mold. Methods for determining these optimal speeds are well known by those skilled in the art.

Mold tables having mechanical linkages such as cams and/or four-bar linkages have been used to oscillate the molds up and down. However, these linkages are susceptible to wear and do not permit the oscillatory speed(s) of the mold to be changed easily. Moreover, these linkages do not permit the speed at which the mold moves up to be changed independently of the speed at which it moves down without modifying the linkages themselves (e.g., by changing the cam shapes). Further, previous mold tables have not been adapted to permit quick mold changes.

SUMMARY OF THE INVENTION

Among the several objects and features of the present invention may be noted the provision of a batch-casting mold table assembly which is capable of varying the speed at which the mold moves up independently of the speed at which it moves down and vice versa; the provision of such an assembly which is capable of varying the speed of the mold while the mold is moving; the provision of such an assembly which is durable; the provision of such an assembly which permits molds to be quickly changed; and the provision of such an assembly which moves in a highly repeatable fashion.

Briefly, apparatus of this invention is a batch-casting mold table assembly for casting slabs. The assembly comprises a frame positionable over a pit sized for holding cast slabs. The frame is moveable between a slab-casting position in which the frame is positioned directly over the pit for casting slabs and a slab-removal position in which the frame is positioned beside the pit so the pit is accessible for removing slabs. The assembly also comprises at least one hydraulic cylinder mounted on the frame. The cylinder has a piston reciprocally moveable in response to hydraulic fluid entering and leaving the cylinder. In addition, the assembly includes a control system operatively connected to the hydraulic cylinder for controlling movement of the piston and a table for holding a batch-casting mold. The table is moveable up and down in response to the piston movement for oscillating the mold up and down over the cooling pit as molten metal is poured through the mold to produce slabs having a smooth surface finish.

In another aspect, the invention includes a method of batch-casting slabs comprising the steps of oscillating a mold up and down over a pit sized for holding cast slabs and pouring molten metal through the mold to produce slabs. The method also comprises the step of varying the speed at which the mold is oscillated during upward and/or downward movement to produce slabs having a smooth surface finish.

Other objects and features of the invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
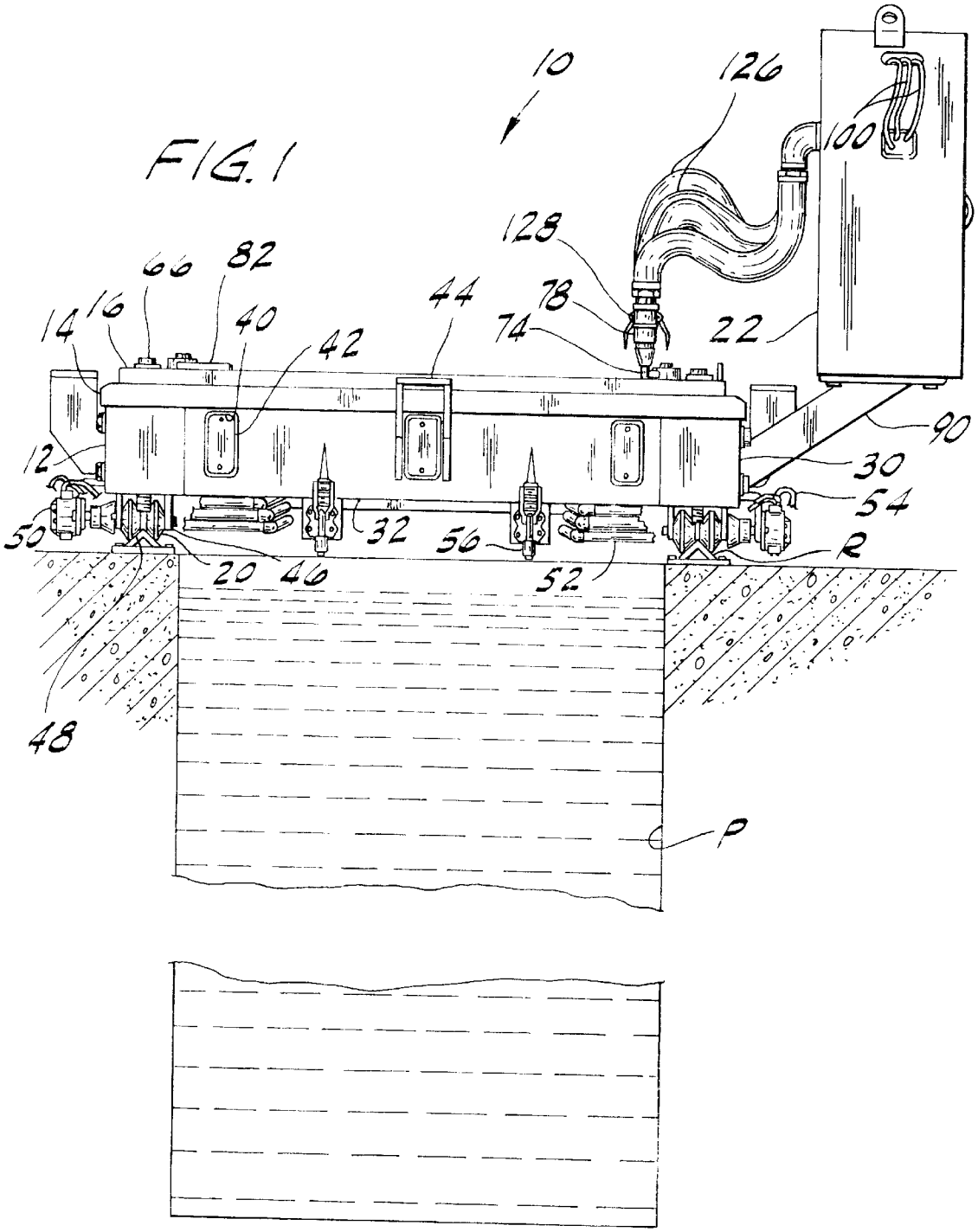
FIG. 1 is a front elevation of a batch-casting mold table apparatus of the present invention positioned over a fluid filled pit.
Figure 2:
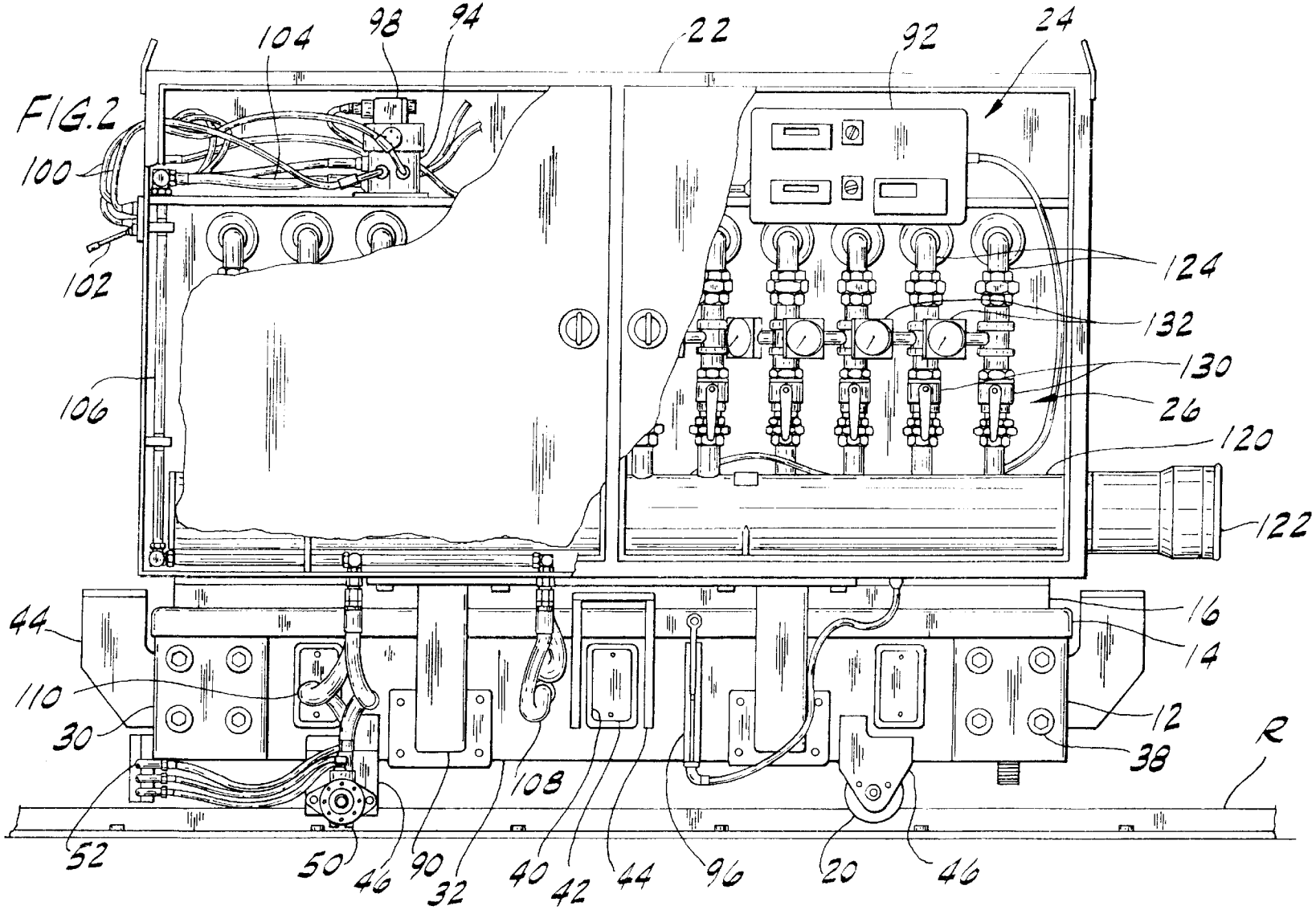
FIG. 2 is a right side elevation of the apparatus partially broken away to show interior features of the apparatus.
Figure 3:
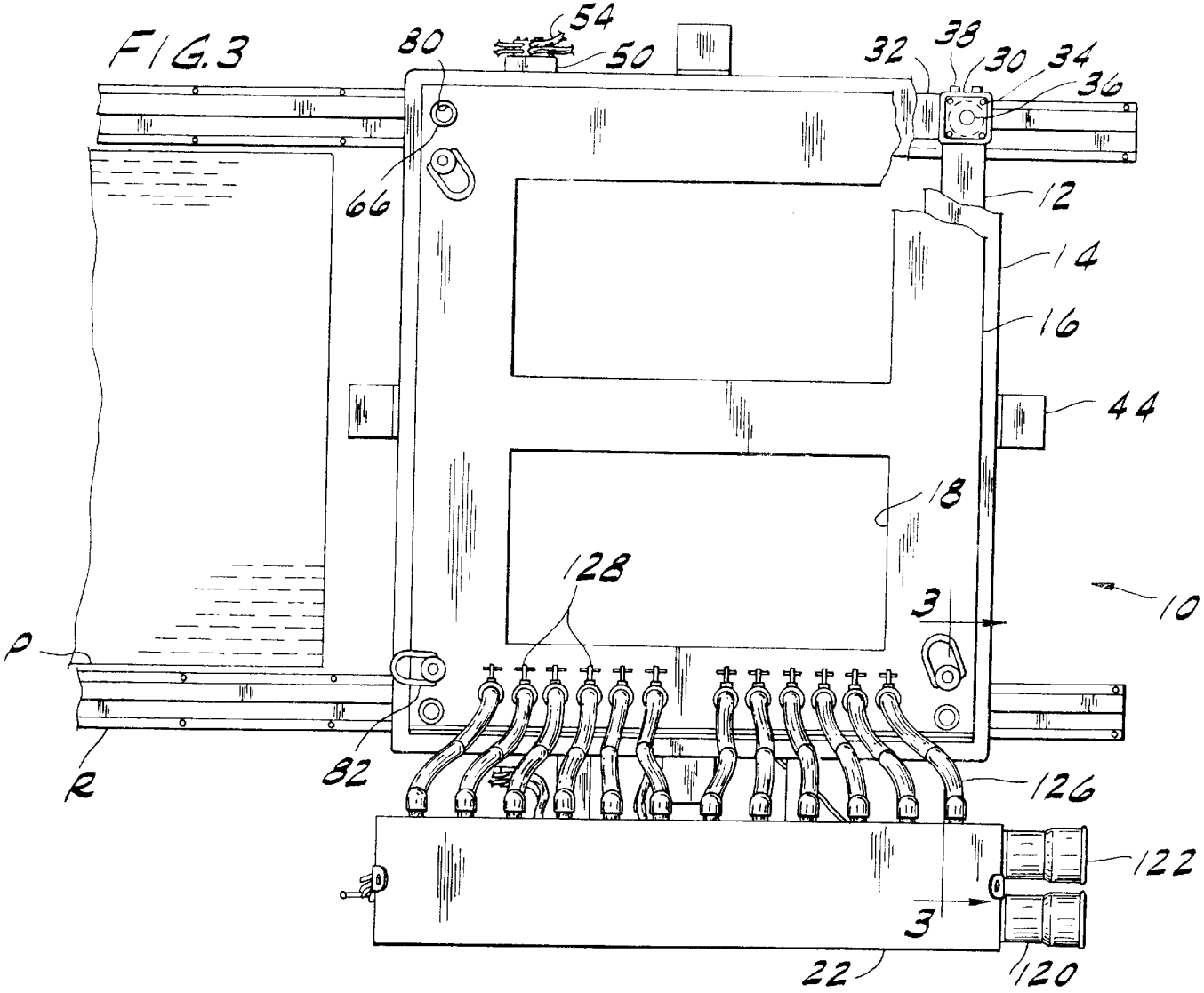
FIG. 3 is a top plan of the apparatus partially broken away to show interior features of the apparatus.

Referring now to the drawings and in particular to FIG. 1, a batch-casting mold table assembly of the present invention is designated in its entirety by the reference numeral 10. The assembly 10 is mounted on rails R positioned on opposite sides of a fluid-filled pit P sized for holding cast slabs (not shown). The assembly 10 generally comprises a frame 12, a table 14 mounted on the frame, and a water jacket 16 mounted on the table. The water jacket 16 has one or more openings 18 (FIG. 3) for receiving a batch-casting mold M (FIG. 4) to hold the mold above the pit P. As will be explained more thoroughly below, the table 14 is moveable up and down to oscillate the mold M up and down over the cooling pit P for producing slabs having smooth surface finishes. The frame 12 is mounted on wheels 20 which engage the rails R so that the assembly 10 may be moved to a slab-casting position in which the frame is positioned directly over the pit P (as shown in FIG. 1) for casting slabs or it may be moved to a slab-removal position in which the frame is positioned beside the pit (as shown in FIG. 3) so the pit is accessible for removing slabs. As shown in FIG. 2, a control cabinet 22 mounted on one side of the frame 12 holds a hydraulic control system, generally designated 24 (FIG. 2), which controls movement of the assembly 10 and a cooling water control system or controller, generally designated 26 (FIG. 2), which controls cooling water flow through the mold M.

As best shown in FIG. 3, the frame 12 comprises four tubular corner housings 30 connected by tubular side members 32. Each of the corner housings 30 houses a conventional double-acting hydraulic cylinder 34 having a piston (not shown) and rod 36 which move reciprocally up and down in response to hydraulic fluid entering and leaving the cylinder. The cylinders 34 are attached to the frame 12 with screw fasteners 38. Although other cylinders may be used without departing from the scope of the present invention, the cylinders 34 of the preferred embodiment are Model D1560-41-21S-8x1 hydraulic cylinders sold by Milwaukee Cylinder Co. of Cudahy, Wis. Access ports 40 covered by panels 42 are spaced around the frame 12 for servicing hydraulic lines (not shown) which extend through the hollow interior of the frame for supplying the cylinders 34 with hydraulic fluid. The center panels 42 are pivotally attached to the frame 12 with hinges (not shown). Enclosures 44 partially surround the center access ports 40 to prevent damage to the respective panels 42 when they are swung open.

As illustrated in FIG. 2, plates 46 extend down from the inside and outside surfaces of each side member 32 for mounting the wheels 20 upon which the frame 12 moves. As shown in FIG. 1, the wheels 20 have V-shaped grooves 48 for rollably engaging the angled surfaces of the rails R mounted on opposite sides of the pit P to prevent the wheels from derailing. Two of the wheels 20 are powered by hydraulic rotary actuators or motors 50 for moving the assembly 10 back and forth between the slab-casting position and the slab-removal position (shown in FIGS. 1 and 3, respectively). Pipes 52 and hoses 54 extending horizontally beneath one end of the frame 12 supply the motors 50 with hydraulic fluid. Two manually extendable stands 56 (FIG. 1) positioned on the frame 12 adjacent the pipes 52 may be extended downward to prevent the pipes from being crushed by the assembly 10 when it is removed from the rails R for servicing.

Figure 4:
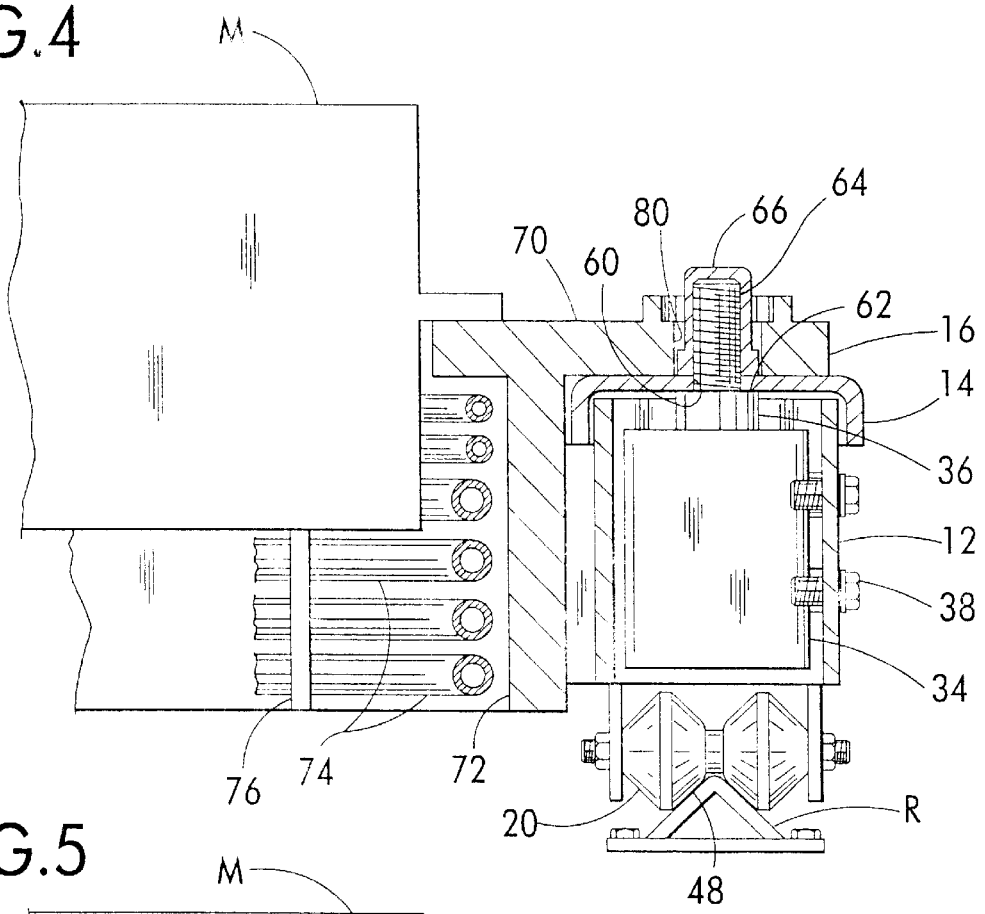
FIG. 4 is a fragmentary cross section taken in the plane of line 4—4 of FIG. 3 showing a piston in a lowered position.
Figure 5:
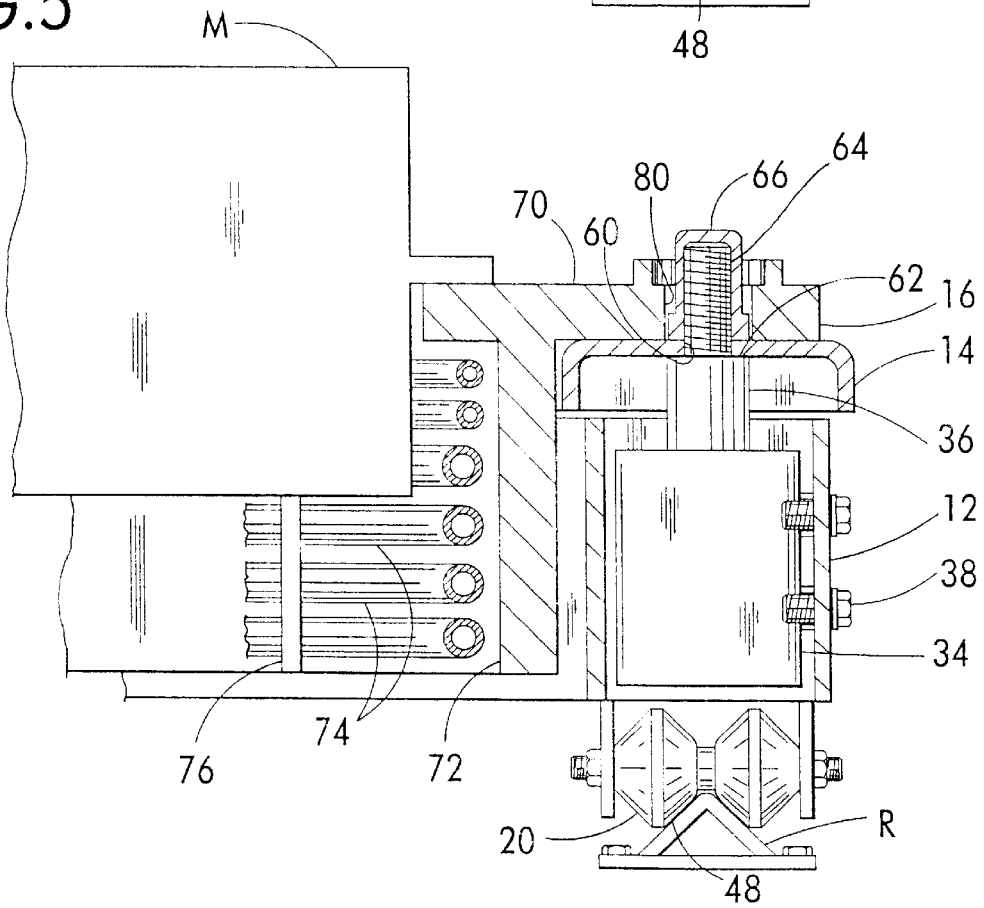
FIG. 5 is a fragmentary cross section similar to FIG. 4 except showing the piston in a raised position.

The table 14 is fabricated by welding sections of channel together to form a rectangular platform having a large central opening as shown in FIG. 3. As shown in FIGS. 4 and 5, a hole 60 is provided adjacent each corner of the table 14 for receiving a corresponding end of one of the cylinder piston rods 36. Each piston rod 36 has a shoulder 62 adjacent a threaded portion 64 so that an acorn nut 66 threadably fastened over the end of the rod holds the table 14 firmly against the shoulder. As a result, the table 14 moves up and down with the piston and rod 36 as hydraulic fluid enters and leaves the cylinder 34.

As further illustrated in FIGS. 4 and 5, the water jacket 16 generally comprises a plate 70 which has the openings 18 for receiving the molds M. Surrounding each opening 18 is a housing 72 having an open top and bottom which extends down from the lower surface of the plate 70. Pipes 74 extending around the inside of each housing 72 provide passages for transporting water or other cooling fluids through the water jacket 16 to the molds M where it is used to cool the molds and the molten material poured through the molds. Brackets 76 spaced at intervals around the interior of the housings 72 hold the pipes 74 in position. As illustrated in FIG. 1, one end of each pipe 74 is routed upward through the plate 70 to a bank of quick disconnect fittings or couplings 78 positioned along one side of the cooling jacket 16. The other end of each pipe 74 has a conventional pipe fitting (not shown) for connecting the pipes to the mold piping.

When installed on the table 14, the cooling jacket 16 rests on the table so that the bottom of the cooling jacket plate 70 bears directly on the upper surface of the table. A hole 80 is formed in the plate 70 near each corner for receiving the acorn nuts 64 which fasten the table 14 to the piston rods 36 so that the cooling jacket 16 is properly located with respect to the table. The holes 80 and nuts 64 maintain the cooling jacket 16 in an appropriate position during use, but permit the cooling jacket and associated molds M to be easily and quickly removed from the assembly 10 by lifting the cooling jacket off table 14. This permits the molds M and cooling jacket 16 to be replaced with other molds and jackets (not shown). As shown in FIG. 3, lifting eyes 82 are positioned adjacent each hole 80 for lifting the cooling jacket 16 off the table 14 with a sling and hoist (not shown) as will be explained in more detail below. Although other materials may be used without departing from the scope of the present invention, the frame 12, table 14, and cooling jacket 16 of the preferred embodiment are made of steel.

As shown in FIG. 1, tubular brackets 90 angle upward and outward from one side of the frame 12 for holding the control cabinet 22 which houses the hydraulic and cooling water control systems 24, 26, respectively (FIG. 2). The hydraulic control system 24 generally comprises an electronic controller 92 and a servo valve 94. A linear transducer 96 connected between the frame 12 and the table 14 measures the position of the table relative to the frame and sends a corresponding signal to the controller 92. In response to this signal, the controller 92 sends a voltage signal to a signal conditioner 98 which converts the voltage to an electrical current signal for controlling the servo valve 94. Hoses 100 supply the servo valve 94 with pressurized hydraulic fluid from an external source (not shown). A valve 102 connected to the hoses 100 starts and stops the flow of hydraulic fluid from the external source to the servo valve 94. Hoses 104 connected to the downstream side of the servo valve 94 are connected to tubes 106 extending down through the cabinet 22 to other hoses 108, 110 which lead to the cylinders 34 and the motors 50, respectively. Thus, the servo valve 94 controls flow of hydraulic fluid to and from the cylinders 34 and motors 50 thereby controlling movement of the assembly 10. The transducer 96 is needed because the speed at which the cylinder rods 36 travel is dependent upon the pressure of the hydraulic fluid delivered to the control system 24. Because this pressure may vary, the exact cooling jacket 16 position is not known and must be measured. Although other controllers and transducers may be used without departing from the scope of the present invention, the controller 92 and transducer 96 of the preferred embodiment are a model BDD-CC08-1-P controller and a model BTL-2-P1-0102-F-S32 transducer sold by Balluff Inc. of Florence, Ky. Likewise, although other servo valves and signal conditioners may be used without departing from the scope of the present invention, the valve 94 and conditioner 98 of the preferred embodiment are a model 631-188C valve and a model N121-132A conditioner sold by Moog, Inc. of East Aurora, N.Y.

As illustrated in FIG. 2, two manifolds 120 (only one of which is visible in FIG. 2) extend horizontally along the bottom of the control cabinet 22. Water enters the manifolds 120 through their respective inlet ends 122 (FIG. 3) from an external source (not shown). Pipes 124 extend vertically upward from the manifolds 120 for transporting water delivering to the manifolds to flexible braided hoses 126 (FIG. 1) outside the cabinet 22. The braided hoses 126 include quick disconnect couplings 128 at their discharge ends for connecting the hoses to the quick disconnect couplings 78 on the pipes 74 extending upward from the cooling jacket 16. A valve 130 and pressure meter 132 are positioned along each of the pipes 124 extending from the manifolds 120 for controlling and monitoring flow though each of the respective pipes. Together the manifolds 120, pipes 124 and associated valves 130 and meters 132 form the cooling water control system 26.

To operate the assembly 10 described above, the controller 92 is connected to an electrical source (e.g., a 110 VAC source), the input hoses 100 are connected to a pressurized hydraulic fluid source (e.g., a 1000–1200 psi source capable of delivering at least about 4–6 gallons per minute), and the inlet ports of the manifolds 120 are connected to an external water source capable of delivering water at a conventional flow rate. When activated, the controller 92 sends a signal to the signal conditioner 98 which controls the servo valve 94. Depending upon the function selected by the operator, the servo valve 94 either directs hydraulic fluid through the hoses 108 leading to the cylinders 34 or it directs the fluid through the hoses 110 leading to the motors 50. When the servo valve 94 directs fluid to the cylinders 34, the controller 92 causes the servo valve 94 to alternately pressurize the extend sides and the retract sides of the double-acting cylinders so their rods 36 reciprocate up and down, thereby causing the mold M to oscillate up and down with respect to the table 12.

As will be apparent to those skilled in the art, the assembly 10 described above, and the hydraulic control system 26 in particular, allow several operating parameters to be precisely and independently controlled. For instance, the stroke length of the rod 36 is infinitely variable within a specified range (e.g, about 0.1–0.25 inches). Likewise, the frequency of strokes is infinitely variable within some range (e.g., from about 1.33 to about 3 strokes per second). Further, the speed at which the rod extends may be controlled independently of the speed at which it retracts so that the table oscillations may be precisely controlled. Although it is generally preferred that the table 14 rise about twice as fast as it falls, the upward and downward movements of the table are independently controllable with respect to one another and the ratio of these movements is infinitely variable using the hydraulic control system 24 described above. Moreover, the stroke length and frequency, as well as the upward and downward speeds of the table 14 may be changed while the table is moving. Therefore, using the apparatus 10 described above, these parameters may be changed while a slab is poured if desired.

When the controller 92 directs fluid to the motors 50, the wheels 20 rotate to drive the assembly along the rails R toward the selected position. Thus, the assembly 10 may be rolled from the slab-casting position to the slab-removal position at the end of a batch to remove slabs from the pit P, and it may be rolled back to the slab-casting position before the next batch to position the assembly over the pit P.

When the operator wants to exchange molds, such as before casting a different shape slab, the operator stops the flow of water to the mold by closing the valves 130 and disconnects the couplings 128, 78 between the hoses 126 and pipes 74. The operator connects a sling and hoist to the eyes 82, and lifts the entire cooling jacket 16 and mold M off the table 14. A second jacket 16 and mold M are lowered into place on the table and the couplings 128 are connected to the couplings 78 on the second jacket. The valves 130 are opened and the next batch of material is cast using the second mold. Exchanging molds takes less than about thirty minutes.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A batch-casting mold table assembly for casting slabs, said assembly comprising:

a frame positionable over a pit sized for holding cast slabs, the frame being moveable between a slab-casting position in which the frame is positioned directly over the pit for casting slabs and a slab-removal position in which the frame is positioned beside the pit so the pit is accessible for removing slabs;

at least one hydraulic cylinder mounted on the frame, the cylinder having a piston reciprocally moveable in response to hydraulic fluid entering and leaving the cylinder;

a control system operatively connected to the hydraulic cylinder for controlling movement of the piston; and a table for holding a batch-casting mold connected to the hydraulic cylinder so that the table moves up and down in response to the piston movement for oscillating the mold up and down over the cooling pit as molten metal is poured through the mold thereby to produce slabs having a smooth surface finish.

2. An assembly as set forth in claim 1 further comprising a water jacket mounted on the table having an opening for receiving the batch-casting mold.

3. An assembly as set forth in claim 2 wherein said mold is a first mold and said water jacket is a first water jacket removably attached to said cylinder so that said first jacket and said first mold may be replaced quickly with a second jacket and a second mold by detaching said first jacket from the cylinder and by attaching said second jacket to the cylinder.

4. An assembly as set forth in claim 3 wherein said cylinder includes a rod extending from the piston up through a hole in the jacket for removably attaching the jacket to the cylinder.

5. An assembly as set forth in claim 4 wherein said first jacket and said first mold are replaced by lifting said first jacket off the cylinder to disengage the rod from the hole in said first jacket and by lowering said second jacket onto the cylinder to engage the rod with a hole in said second jacket.

6. An assembly as set forth in claim 3 wherein said first and second water jackets include quick disconnect fittings for quickly connecting and disconnecting said jackets from a water supply.

7. An assembly as set forth in claim 2 further comprising a controller operatively connected to the water jacket for controlling water flow through the jacket.

8. An assembly as set forth in claim 7 wherein the water jacket has a plurality of passages for transporting water through the water jacket to cool the mold and the controller selectively controls water flow through each of said passages.

9. An assembly as set forth in claim 1 wherein the frame includes a plurality of wheels spaced for rollably engaging surfaces on opposite sides of the pit to move the frame between the slab-casting position and the slab-removal position.

10. An assembly as set forth in claim 9 wherein at least one of said plurality of wheels is motorized for driving the frame between the slab-casting position and the slab-removal position.

11. An assembly as set forth in claim 9 wherein said wheels are configured for rolling along rails mounted on said opposite sides of the pit.

12. An assembly as set forth in claim 1 wherein the control system is operable to selectively vary the speed of the piston during upward and/or downward movement thereof.

13. An assembly as set forth in claim 12 wherein the control system is operable to change the speed of the piston while the assembly is operating.

14. A method of batch-casting slabs comprising the steps of:

oscillating a mold up and down over a pit sized for holding cast slabs;

pouring molten metal through the mold to produce slabs; and varying a speed at which the mold is oscillated during upward and/or downward movement to produce slabs having a smooth surface finish.

15. A method as set forth in claim 14 wherein the step of varying the speed is performed while the mold is oscillating.

16. A method as set forth in claim 14 further comprising the steps of:

moving the mold from a slab-casting position in which the mold is positioned directly over a pit for casting slabs to a slab-removal position in which the mold is positioned beside the pit so the pit is accessible for removing slabs; and removing slabs from the pit.

* * * * *